United States Patent [19]

Howard et al.

[11] Patent Number: 4,966,207

[45] Date of Patent: Oct. 30, 1990

[54] DISPOSABLE CHEMICAL CONTAINER

[75] Inventors: Richard E. Howard, Escondido; Joseph P. Keene, Oceanside, both of Calif.

[73] Assignee: Air Products and Chemicals, Inc., Allentown, Pa.

[21] Appl. No.: 359,245

[22] Filed: May 31, 1989

Related U.S. Application Data

[62] Division of Ser. No. 947,913, Dec. 29, 1986, Pat. No. 4,851,821.

[51] Int. Cl.[5] ..... B65B 3/04

[52] U.S. Cl. ..... 141/98; 141/95; 141/18; 141/329; 206/524.5; 220/455; 340/624; 261/121.1; 261/72.1

[58] Field of Search ..... 206/524.5, 524.3, 524.2; 220/455, 426; 141/95, 98, 18, 329, 330; 137/558; 261/64.1, 65, 121.1, 72.1; 340/622, 624

[56] References Cited

U.S. PATENT DOCUMENTS 3,724,712 4/1973 Starr et al. ..... 220/63 R
4,298,037 11/1981 Schumacher et al. ..... 141/1
4,738,356 4/1988 Gunkel et al. ..... 206/524.5

OTHER PUBLICATIONS

Packaging 9/86, vol. 31, No. 10, p. 14, "HDPE bottle".

*Primary Examiner*—Ernest G. Cusick
*Assistant Examiner*—Edward C. Donovan
*Attorney, Agent, or Firm*—James C. Simmons

[57] ABSTRACT

A disposable container for shipping a hazardous or ultra-high purity liquid material is disclosed, having a body of substantially vapor-impermeable organic polymer material, such as fluorinataed linear high-density polyethylene, a bubbler tube extending from the top of the container having an open end near the bottom of the container, a liquid level detector, and an outlet tube on the top of the container having an open bottom end near the top of the container. A vapor-impermeable metal coating is provided on the outside of the container by vapor deposition or sputtering. A frangible seal is provided at the top of both the inlet tube and the outlet tube. A metal-coated polymer valve is provided on the bubbler, having vapor-impermeable seals isolating the metal exterior from the metal interior, and also having means for rupturing the frangible seal.

1 Claim, 2 Drawing Sheets

FIG. 1
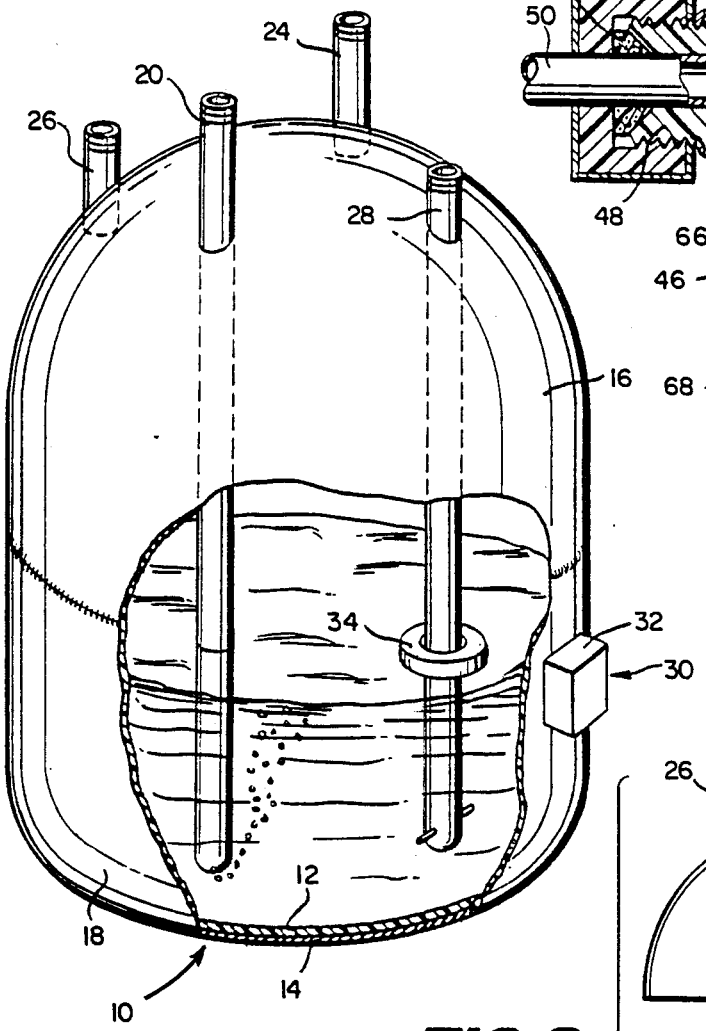
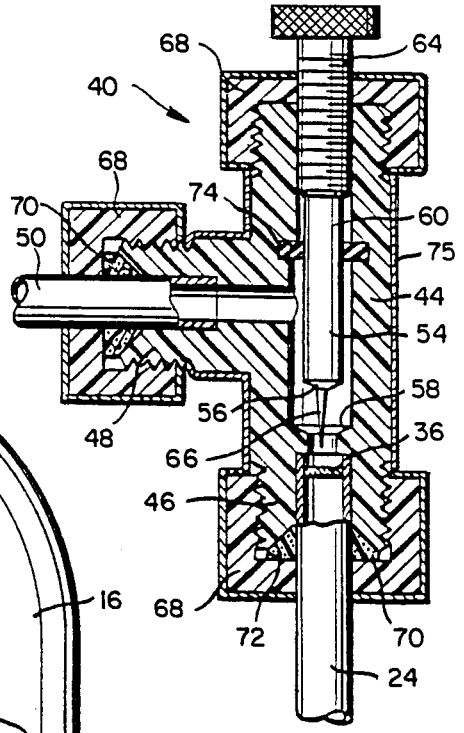
FIG. 3
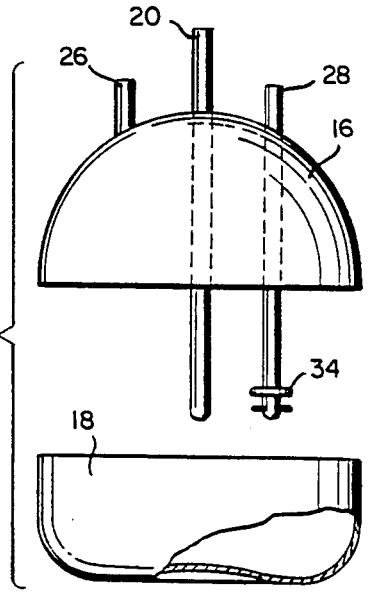
FIG. 2

DISPOSABLE CHEMICAL CONTAINER

This application is a division of U.S. patent application Ser. No. 947,913 filed Dec. 29, 1986, now U.S. Pat. No. 4,851,821.

FIELD OF THE INVENTION

This invention relates to a disposable container for shipping toxic and corrosive liquid chemicals. In particular, this invention relates to a container for transporting ultra high-purity liquid chemicals of the type used, e.g., in the manufacture of semiconductors and optical fibers.

BACKGROUND OF THE INVENTION

Many manufacturing processes utilize high-purity chemicals entrained in a carrier gas for such processes as semiconductor doping, vapor depostion, etching, and molecular impregnation of a substrate with the entrained chemical. In many of these applications, the purity of the chemical is critical, and impurities are measured in parts per billion. Contamination, such as that which may occur during shipping and handling, must be avoided at all costs.

For example, some of the chemicals used in the manufacture of semiconductor devices are liquid phosphorous oxychloride, phosphorous trichloride, phosphorus tribromide, trichloroethylene, tetramethoxysilane, silicon tetrabromide, trichloroethane, arsenic trichloride, arsenic tribromide, and antimony pentachloride. Many of these chemicals, such as the arsenic compounds, are highly toxic. Others, such as the bromine compounds, are extremely corrosive. Accordingly, worker exposure must be minimized. At the same time, care must be taken to assure that the highest level of purity of these chemicals is maintained. Even the slightest contamination may affect the yield of semiconductor devices, which directly affects the profitability of the overall fabrication process.

In the past, such chemicals have typically been shipped in flame-sealed glass ampules capable of meeting the pertinent Department of Transportation regulation requiring containers capable of holding 15 psi pressure. (Although certain metal containers may also satisfy the applicable DOT regulations, such containers are unacceptable because of the problem of metallic contamination, which is particularly harmful to the reliable manufacture of semiconductors.) When the glass containers were received, they were typically opened by breaking the seal, after which they were emptied into a bubbler. A bubbler is a device which permits a carrier gas, such as nitrogen, to be bubbled through the liquid source material, whereby the liquid source material becomes entrained in the gas. The carrier gas, with entrained chemical, is typically supplied to the substrate to be treated, e.g., in a diffusion furnace or a vapor deposition chamber. As is readily apparent, the transfer of the liquid source material from the glass shipping ampule to the bubbler was a serious potential source of atmospheric and moisture contamination and worker exposure to the chemical.

One relatively satisfactory solution to the contamination and exposure problem is the quartz container disclosed, for example, in U.S. Pat. Nos. 4,134,514, 4,140,735, and 4,298,037. These patents disclose high-purity quartz bubblers which double as shipping containers. The quartz bubblers are filled with chemical by the supplier; the fill tube is flame-sealed, in accordance with DOT regulations; the bubbler containing chemical is then shipped to the user, who attaches gas lines, breaks a seal, and monitors the temperature control equipment to the bubbler, and uses the chemical as desired. Although the majority of contamination problems are thus avoided, since there is no need to transfer the chemical from the shipping container into a separate bubbler, one drawback of this system is the expense involved. High purity quartz containers are relatively costly. For this reason, it has been the practice in the industry to return empty quartz bubblers to the chemical supplier to be refilled. This involves a return shipping expense. Moreover, as the inlet, outlet, and fill tubes are repeatedly heated and resealed, the crystalline structure of the quartz can be affected, causing the quartz to become brittle or crumble. As a result, the bubbler must be carefully examined at each refill time. Some bubblers can only be used as few as three times, others may last for 10 to 12 refills, with the average being in the neighborhood of five to six times.

No suitable less costly alternatives to the quartz bubbler has been apparent to those of ordinary skill in the semiconductor and related supporting industries. Most alternatives considered have been ruled out for failure to satisfy shipping regulations, imcompatibility with the chemicals to be shipped, or contamination of those chemicals by the material itself.

A major problem that appears to rule out the use of organic polymer materials for bubblers is air and moisture contamination of the contained liquid source material. Even minute amounts of moisture contamination can have extremely deleterious effects on semiconductor yield. Although many organic polymers are commonly believed to be impermeable vapor barriers, in truth, small amounts of air and moisture are able to infiltrate nearly all such materials. One graphic illustration of this phenomenon is the gradual shrinking of a child's balloon as pressurized air escapes through the walls of the balloon itself.

The current cost of even small (500 ml.) high-purity quartz bubblers is on the order of several hundred dollars—often approaching or being more than the cost of the chemicals they contain. It is significant that, despite the existence of the problem for a number of years, and the almost overwhelming economic incentive involved, no suitable low-cost alternative bubbler has heretofore been developed.

Accordingly it is an object of the present invention to provide a relatively inexpensive bubbler suitable for transporting toxic and corrosive ultra high-purity liquids. It is a further object of the present invention to provide a disposable bubbler made of organic polymer material. Another object of the present invention is to provide a low-cost bubbler that avoids atmospheric contamination, moisture contamination, and contamination of the contained liquid source material by the container itself. Still another object of the present invention is to provide a valve for use on a bubbler that is vapor impermeable, and yet provides no possibility of metallic contamination of the liquid source material.

SUMMARY OF THE INVENTION

In furtherance of the foregoing objects, there is provided in accordance with the present invention a disposable article for shipping a hazardous liquid material, comprising a container body of substantially vapor-impermeable organic polymer material having a top and a bottom, a first opening in the top of the container, a tube extending from the first opening into the container, having an open bottom end near the bottom of the container, a second opening in the top of the container, a frangible seal in the first and second openings for sealing the openings, and a vapor-impermeable metal coating on the outside of the container in intimate contact with the organic polymer material. The metal coating is preferably a vapor-deposited coating of chromium, nickel, or zinc. The organic polymer material may be any suitable vapor- and moisture-impermeable polymer, such as linear ultra-high molecular weight or high density polyethylene or other polyolefin, a styrenic polymer, polyethylene terephthalate, melamine formaldehyde, fluoropolymers, chlorofluoro polymers or multiple layers of different polymers, such as polytetrafluoroethylene, polyethylene, polyvinylidine chloride, and the like.

In accordance with another embodiment of the invention, there is disclosed a bubbler corresponding to the foregoing general description in combination with a corrosive or toxic liquid chemical.

In accordance with still another embodiment of the present invention, there is disclosed a disposable article for shipping hazardous liquid material, comprising a container of substantially vapor-impermeable organic polymer material having a top and a bottom, means for introducing a carrier gas into the bottom of the container, means for removing carrier gas from the top of the container, and a vapor-impermeable metal coating deposited on the outside of the organic polymer material of the container. The liquid level detector utilizes either a floating container of magnetic material or a heater in close proximity to a heat detector, the heat detector being actuated when liquid inside the container is no longer present to conduct heat away from the heater and heat detector.

In accordance with still another aspect of the present invention, there is provided a valve on the container for controlling the flow of carrier gas, or other fluid, into or out of the container, the valve comprising an inlet port, an outlet port, an interior of a nonreactive organic polymer, silicone, glass, or ceramic material, vapor-impermeable seals at the inlet port and the outlet port, a vapor-impermeable metal on the exterior of the valve up to the seals, so that the exterior of the valve, which may experience ambient contact, is substantially completely covered with metal and the interior surfaces of the valve, which are in contact with the fluid controlled by the valve, are substantially metal free.

In yet another embodiment of the present invention, there is provided a moisture-impermeable bubbler having an organic polymer interior and a metal exterior, and an ultra-high purity liquid chemical inside the bubbler, the organic polymer material being nonreactive with and noncontaminative of the liquid. A valve may also be provided on the bubbler having a metal exterior, and an organic polymer interior that is nonreactive with and noncontaminative of the liquid in the bubbler.

In accordance with another aspect of the invention, a fluid control valve is provided with an inlet port, an outlet port, a substantially metal-free interior of organic polymer material defining a fluid passageway, a vapor-impermeable metal exterior, fluid control means inside the fluid passageway, means extending from the exterior to the interior of the valve for actuating the fluid control means, and vapor-impermeable seals at the inlet port, the outlet port, and on the actuating means which separate the metal exterior from the metal-free interior, and prevent ambient contact with the interior when the valve is in use. The seals may be made of an organic fluoropolymer, a polyolefin, a polyvinyl resin, a polyamide, or, preferably, graphite.

BRIEF DESCRIPTION OF THE DRAWINGS

FIG. 1 is a partially cutaway perspective view of a bubbler according to the present invention.

FIG. 2 is an exploded side view of the bubbler according to the present invention, illustrating a two-piece construction.

FIG. 3 is a side view of a vertical crosssection of a valve positioned above the seal in the inlet tube of the bubbler.

DETAILED DESCRIPTION OF PREFERRED EMBODIMENTS

Figure 4:
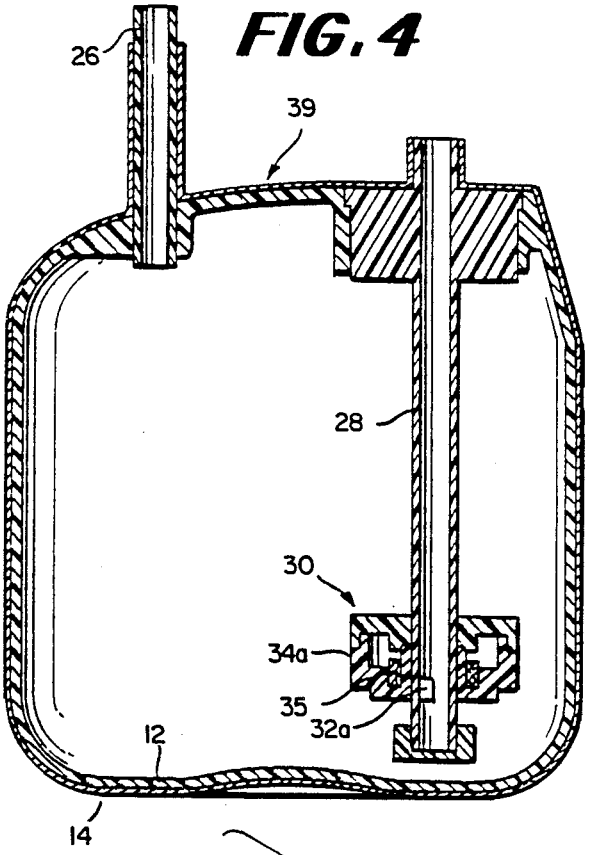
FIG. 4 is a vertical cross-section of a rotationally-molded bubbler having a one-piece body.

With reference to FIG. 1, the bubbler 10 according to the present invention is an enclosed rigid-walled container having a wall 12 made of organic polymer material. On the outside of the wall 12 is a thin metal coating 14.

The organic polymer material is selected to be compatible with the liquid source materials to be placed in the container. A nonreactive polymer is essential to avoid contamination of the liquid source material. One type of polymer satisfying this requirement for many years is polyethylene. Ultra high molecular weight or high-density polyethylene ("LHDPE") is particularly preferred. Other suitable polymers include other polyolefins, polyvinylidene chloride (PVDC), and ethylene/vinyl alcohol copolymer. The use of a polyamide such as a nylon as a filler in the polymer may further increase desirable properties by creating an additional tortuous-path barrier.

Organic fluoropolymers and copolymers are also suitable for making the disposable bubbler. Such materials include polytetrafluoroethylene, hexafluoropropylene/tetrafluoroethylene copolymer, ethlene/chlorotrifluoroethylene, ethylene/tetrafluoroethylene copolymer, polyvinylidenefluoride, polyvinylfluoride, and the like.

High molecular weight polyethylene terephthalate may be suitable, either alone, or in combination with another polymer such as ethylene/vinyl alcohol copolymer or polyvinylidene chloride.

Still other polymers which may be suitable for purposes of the present invention include, either alone or in combination, other polyvinyl resins, urea formaldehydes, melamine formaldehydes, phenolics, furans, polyimides, polyxylenes, polyvinylesters, polybenzimidazoles, polyphenylenes, polymethylene oxides (acetal), and chlorinated polyethers.

Multi-layer material consisting of more than one organic polymer may also advantageously be used. For example, the wall 12 may have an inner layer of one of the polyolefins, which are relatively nonreactive polymers, and a next layer of a material such as polyvinylidene chloride, which has good vapor barrier properties. Other layers may be added to improve barrier properties, provide increased strength, or to take advantage of advantageous properties of other polymers. A preferred layered polymer material has an inner layer of LHDPE, preferable filled with nylon, a barrier layer of ultra high molecular weight polyethylene polyvinylidene chloride, and an outer layer of ultra high molecular weight polyethylene LHDPE, again preferably incorporating nylon as a filler. An adhesive or "tie material" is used to bond the layers, as is conventional.

Although the foregoing organic polymer materials possess sufficient barrier properties for most conventional applications, they may, by themselves, be unsuitable for purposes of the present invention because minute but harmful amounts of moisture and air may, nevertheless, diffuse through the material and into the container. Accordingly, to maximize the barrier properties of the wall 12, the present invention provides a metal coating 14 on the exterior of the bubbler. Such a metal coating provides a highly effective barrier to gas and moisture. Although the metal is applied to the outside of the container, it is nevertheless desirable that the metal be relatively nonreactive with the liquid source material inside the container because of possible spillage of the liquid on the container exterior, or other inadvertent contamination. Suitable metals include nickel, chromium, zinc, tantalum, tungesten, molybdenum, and zirconium. Of these, nickel, chromium, and zinc are particularly preferred. Aluminum and stainless steel may be considered in applications where their relatively reactive nature is not a problem. Any of the noble metals, especially platinum, would also be suitable, although cost will usually be a drawback.

The metal coating process is preferably carried out by sputtering, or by a conventional vapor-deposition process. To prevent damage to the metal coating, a scratch-protection coating may be applied after metallization. A transparent polymer coating, such as polyvinylidene chloride, polyurethane, or LHDPE is preferred, although other protective coatings, such as paint, may be used. This coating is preferably applied to the bubbler as a melt, an emulsion, a suspension, or in a solvent vehicle. The use of such a coating may also render more practical the use of inexpensive, but reactive metals such as aluminum.

To even further enhance the barrier properties of the organic polymer material, it may be fluorinated, as disclosed in U.S. Pat. Nos. 3,998,180, 4,081,574, and 4,142,032, which are hereby incorporated by reference.

As is shown in FIG. 2, the bubbler 10 may be formed of a top piece 16 and a bottom piece 18. Two-piece construction simplifies injection molding processes, and is also suitable when the bubbler is formed of layered sheet stock by vacuum molding. If the bubbler is formed in two pieces 16 and 18, the pieces may be joined by any suitable method, such as by ultrasonic welding.

Alternatively, the bubbler 10 may be formed in one piece by rotational molding, or blow molding, as is shown in FIG. 4. One piece construction simplifies the molding process and eliminates the circumferential seam, a potential trouble spot and source of leakage in a two-piece design.

The bubbler 10 has an inlet tube 20 extending, generally, vertically through the top of the bubbler 10 into the interior of the bubbler 10 and extending to within close proximity of the bottom of the container. The inlet tube 20 has an opening at the bottom thereof in order that a carrier gas may be introduced into the bubbler through the inlet tube 20, and may bubble up through the liquid source material inside the bubbler, whereby the carrier gas becomes saturated with the liquid source material. Alternatively, the inlet tube may extend through the side or the bottom of the bubbler 10.

An outlet tube 24 is also provided to permit the saturated carrier gas to flow out of the bubbler 10 to be utilized in whatever manner is desired. The outlet tube 24 extends through the top of the bubbler 10 into the inside, and has an open end inside the bubbler 10 near the top thereof.

The bubbler 10 may also be provided with a fill tube 26 extending through the top of the bubbler 10 into the interior thereof for introducing liquid source material into the bubbler. A thermowell tube 28 may also be provided. The thermowell tube 28 extends through the top of the bubbler 10 and extends generally vertically down into the inside of the bubbler 10. The thermowell tube, unlike the inlet tube 20, the outlet tube 24, and the fill tube 26, has a closed bottom end. One purpose of the thermowell tube is to permit the temperature of the liquid source material contained in the bubbler 10 to be monitored. In use, the thermowell tube 28 is at least partially filled with a heat transfer substance, such as mineral oil or a silicone oil. A temperature sensor in the thermowell tube can, thus, monitor the temperature of the liquid source material.

A liquid level detector 30 is provided to permit remote monitoring of the level of the liquid source material. Although any type of liquid level detector desired may be used, the preferred detector is a two-part detector having a fixed portion 32, and a movable portion 34. The movable portion 34 may comprise a magnetic material encased or coated in a nonreactive substance such as fluorinated polyethylene. In the embodiment shown in FIG. 1, the movable portion is slidably mounted on the thermowell tube 28. The movable portion 34 floats on the liquid source material. As the level of liquid source material drops, the movable portion 34 slides down the thermowell tube 28 until it comes into the proximity of the fixed detector portion 32. The fixed detector portion 32 comprises means to detect the proximity of th movable portion 34. Suitable detectors include a magnetically actuated reed switch or a coil. The fixed detector portion 32 may be mounted either on the outside of the bubbler 10, or preferably, inside the thermowell tube 28, as shown in FIG. **32*a* in FIG. 4. The magnetic material 35 in movable portion 34*a*** may advantageously be contained in a sealed quartz tube, or other container having sufficient air space inside to float.

In a preferred embodiment, as shown in FIG. 4, the movable portion **34*a*, is a hollow, plastic container surrounding the thermowell tube 28. A magnet 35 is positioned inside the hollow of movable portion 34*a*. An air space may be provided in movable portion 34*a* if necessary to provide buoyancy. The fixed detector portion 32*a* is provided inside the thermowell tube 28. Alternatively, the movable portion 34*a* may contain a ferrous material, and the fixed detector portion 32*a*** may incorporate a magnet.

Figure 5:
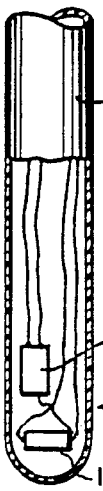
FIG. 5 is a side, cutaway view of a thermal level detector.

In an alternative embodiment, shown in FIG. 5, the liquid level detector 130 may be thermally actuated. One suitable design is a small heater 132 in close proximity to, or in contact with, a thermal switch 134, mounted on or in the bubbler 10. As long as the liquid level in the bubbler 10 is above the detector 130, the heat from the heater 132 is rapidly conducted away from the thermal switch 134. When the liquid level drops below the detector 130, the heater causes the thermal switch to open (or close). Suitable heaters include resistive heaters, such as ordinary resistors, to which a constant voltage may be applied during operation of the bubbler. Suitable thermal switches include thermal fuses and bimetal switches. Other temperature detectors, such as thermistors, could also be used.

Figure 6:
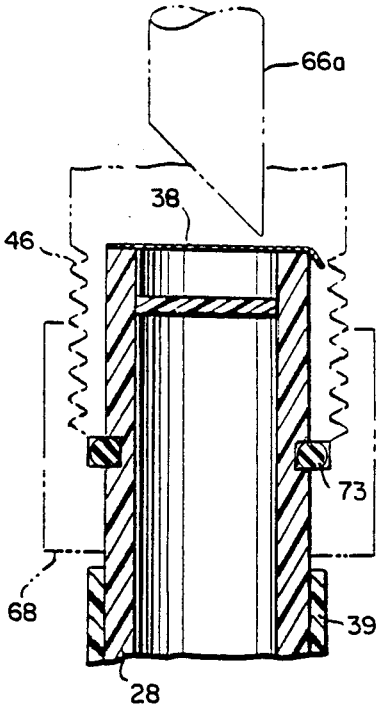
FIG. 6 is a longitudinal cross-section of the outlet tube with a compression connector and rupturing tool shown in phantom.

As illustrated in FIG.3 a frangible breakseal 36 is provided at the top of inlet tube 20 and outlet tube 24. The frangible breakseal 36 may be made of a suitable organic polymer material, such as the material comprising the walls of the bubbler 10, or it may be made of quartz. The breakseal 36 may be placed in inlet 20 and outlet 24 by any suitable means, such as welding or molding. With the frangible breakseals 36 in place, the upper ends of the tubes 20, 24, 26 and 28 are then covered. A preferred method of covering the ends is with an adhesive tab 38 as shown in FIG. 6. The tab 38 may be made of any desired material, although metal sandwiched with a suitable polymeric material is preferred.

In the embodiment of the fabrication process of the bubbler 10, in which the top piece 16 and the bottom piece 18 are separately molded, the tubes 20, 24, 26, and 28 may be fastened into the top piece 16, e.g., by ultrasonic welding. Alternatively, the tubes 20, 24, 26, and 28 may be molded into top piece 16. Both the inside and the outside of top piece 16 and bottom piece 18 are then fluorinated. Alternatively and preferably, the fluorination process is performed after assembly of the top piece 16 and the bottom piece 18.

In another embodiment of the fabrication process, the bubbler shell 39 is fabricated in one piece by rotation molding (See FIG. 4). Holes are then punched for the tubes 20, 24, 26 and 28, which are spin welded into place. In order to accommodate the liquid level detector 30, the hole for the thermowell tube 28 must be oversize. An appropriately enlarged segment is provided near the top of the thermowell tube to mate with the oversize hole. The bubbler shell 39, with tubes 20, 24, 26 and 28 in place, is fluorinated inside and out.

The entire bubbler, including the exposed portions of the tubes and the tabs 38, is then coated with a thin layer of metal. This metal layer is generally at least 0.2 mils thick, and preferably at least 0.6 mils thick. Although an electrodeposition plating process may be used, the preferred methods for applying the metal coating are by either a vapor deposition process, such as conventional flashing, or by sputtering. By applying the metal coating at a slightly elevated temperature (e.g., 140 degrees F.), metal-to-polymer binding strengh is increased and nucleation is minimized. The fluorination step facilitates the subsequent bonding of metal to plastic without the use of an underlying base coat. However, if desired, an extremely light coating (e.g., one molecule thick) of copper may be applied as a base coat. Other conventional base coats may also be used. It should be noted that, because of the tabs 38, the top surface and interior of the tubes 20, 24, 26 and 28, together with the frangible breakseals 36, are protected from metallization. This avoids any possibility that the high-purity liquid source material may become contaminated by the metal used for coating.

The tab 38 is then removed from the fill tube 26, and the bubbler is filled through the fill tube 26 with an ultra high-purity liquid source material that is compatible with the organic polymer material, such as phosphorus oxychloride, phosphorus trichloride, phosphorus tribromide, boron tribromide, trichloroethylene, tetramethoxysilane, silicon tetrabromide, trichlorethane, arsenic trichloride, or antimony pentachloride. These liquid source materials have a purity of at least 99.995% and preferably 99.9999%. Typical impurity levels are 200 ppb or less. The fill tube is then heat sealed or closed by any other appropriate method capable of eliminating the possibility of contamination and leakage. The resulting container is a hermetically-sealed bubbler that meets DOT shipping regulations for the contained liquid source material. The container cost to the customer has been reduced by approximately 80% to 90% from the cost associated with a quartz bubbler.

To use the bubbler, the tabs 38 are removed from the inlet tube 20, the outlet tube 24, and the thermowell tube 28. A valve 40 is then attached to the inlet tube 20 and to the outlet tube 24 as is shown in FIG. 3. The inlet tube 20 and the outlet tube 24 may be provided with threads for attachment of the valve 40. In one embodiment of the invention, the external portions of the inlet tube 20 and the outlet tube 24 are eliminated and the valves are screwed directly into threads holed in the top of the bubbler body. Alternatively, the valves 40 may be attached to the inlet tube 20 and the outlet tube 24 by means of a compression fitting, or by any other suitable means.

The valve 40 shown in FIG. 3 has a valve body 44, an inlet end 46 for attachment to the outlet tube 24, and an outlet end 48, for attachment to a gas line 50. In the interior of the valve, there is a fluid control means 54 for controlling the flow of a fluid through the valve. In the illustrated embodiment, the fluid control means 54 comprises a movable mating surface 56 which is moved into contact with a valve seat 58 to interrupt the flow of fluid through the valve. The mating surface 56 is actuated by a valve stem 60. In the illustrated embodiment, the valve stem 60 has a threaded portion 64 so that the mating surface 56 may be moved into and out of contact with the valve seat 58 by rotating the valve stem 60.

On the mating surface 56, and extending through the valve seat 58, is a rupturing device 66. A pointed, solid rupturing device 66 as in FIG. 3 is appropriate for quartz or glass breakseals. Polymer breakseals usually require a rupturing device 66 capable of maintaining an open fluid passageway through the breakseal. A sharpened tube, as shown at **66*a* in phantom in FIG. 6**, is one suitable design. Other suitable designs may be finned or fluted.

The rupturing device 66 is movable by actuating the valve stem to rupture the frangible breakseal 36.

The valve 40 is connected to the outlet tube 24 by any suitable means. In the illustrated embodiment, the inlet end 46 is provided with exterior threads onto which a compression nut 68 can be threaded. The nut 68 has an annular axial opening therein in order that it may fit over the outlet tube 24. To connect the valve 40 to the outlet tube 24, the nut 68 and a tapered annular ferrule 70 are placed on the outlet tube 24. The inlet end 46 of the valve 40 is then placed on the outlet tube 24 and the nut 68 is screwed onto the inlet end 46, compressing the tapered ferrule 70 against a matching inner taper 72 in the inlet end 46 and against the outlet tube 24. If desired, a notch 73 may be provided in the inlet tube 20, and the outlet tube 24 to accommodate the ferrule 70 (or an "O-ring" or other suitable seal) as shown in FIG. 3.

A similar nut 68 and ferrule 70 are provided for connecting the gas line 50 to the outlet end 48 of the valve 40 in the same manner.

A stem seal 74 is provided in the valve body 44, and is in contact with the valve stem 60. The ferrules 70 and the stem seal 74 prevent all moisture and vapor from the exterior of the valve body 44 from reaching the interior of the valve body 44.

In a preferred embodiment, the entire valve body 44, or at least the interior thereof, is made of a nonmetallic material that is not reactive with, and will not contaminate the contents of the bubbler. Suitable nonreactive materials include organic polymer materials, such as are used in the bubbler, inorganic polymers, such as silicones, ceramic materials, and glass. The ferrule 70 and the stem seal 74 may also be made of a suitable nonreactive material, such as nylon, polytetrafluoroethylene, polyethylene, silicone, or any of the polymers from which the bubbler 10 is made. However, the preferred material for the ferrule 70 and the stem seal 74 is graphite.

Although one particular valve design is illustrated, it will be understood that the valve of the present invention may utilize any type of fluid control means 54, and may be a ball valve, a needle-and-seat valve, a gate valve, a plug valve, a disk valve, a butterfly valve, a telescoping valve, a slide valve, or any other suitable type of fluid control valve.

Regardless of the particular type of valve, all of the valves within the scope of the present invention will have an air- and vapor-tight seal at the inlet, the outlet, and any other channel leading into the interior of the valve.

The valve 40 is preferably coated with a layer of metal 75 of the same type and in the same manner as the bubbler 10, in order to eliminate the possibility of moisture permeation through the valve. The entire exterior of the valve 40 is covered with metal up to the seals that protect the interior of the valve 40 from contamination, e.g., the ferrules 70 and the stem seal 74. When the valve is made of the same organic polymer material as is used for the bubbler, it is preferred that the valve is fluorinated prior to being coated with metal. The nuts 68 may also advantageously be metal coated both inside and out. However, it is critical that all valve parts in fluid connection with the interior of the valve have no metal therein which could contact the fluid passing through the valve.

Thus, the valve according to the present invention has a metal exterior, a nonreactive non-metal interior, and vapor-impermeable seals between the non-metal interior and the metal exterior of the valve 40.

In use, the valve 40 is attached to the outlet tube 24 with a compression fitting as described above, by threading the valve 40 into the body of the bubbler 10, or by any other suitable means. The gas line is also attached to the valve 40, and the valve is purged with an inert gas. The rupturing device 66 is then actuated to rupture the frangible breakseal 36, thereby permitting the flow of gas out of the bubbler.

A second valve 40 is connected to the inlet tube 20 of the bubbler 10 in the same manner as described above.

Figure 7:
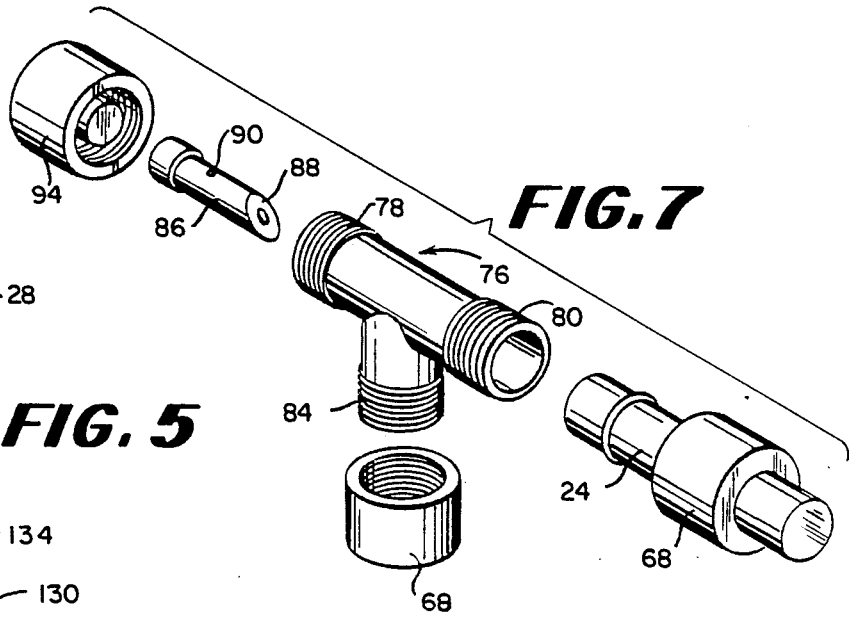
FIG. 7 is an exploded perspective view of a seal-rupturing connector.

In some applications, a fluid-control valve on the inlet tube 20 and the outlet tube 24 is not necessary. For example, users often have fluid control valves in the gas line 50 itself, or at other points in the system. Accordingly, there is also provided in accordance with the present invention a simple "tee" connector 76. The "tee" connector 76 has a top end 78, a bottom end 80 for connection to the outlet tube 24, and an outlet end 84 for connection to a gas line 50. As is shown in FIG. 7, annular nuts 68 are provided for connecting the outlet tube 24 and the gas line 50 (not shown) to the "tee" connector 76.

A plunger 86 is provided which is inserted most of the way into the top end 78 of the "tee" connector 76. The plunger 86 has a sharpened lower end 88 for rupturing the breakseal 36. In the illustrated embodiment, the plunger 86 is tubular so that when extending through the breakseal, it can hold the fragments of the ruptured breakseal open and provide a gas passageway through the breakseal. A hole 90 is provided through the side of the plunger 86 and into the hollow interior so that gas may flow up through the plunger 86 (which has a smaller outside diameter than the inside of the "tee" connector 76), out through the hole 90, and through the outlet end 84 of the "tee" connector 76 to the gas line 50 to be used as desired.

Once the bottom end 80 and the outlet end 84 of the "tee" connector 76 are connected, and the plunger 86 is positioned above the breakseal 36 through the top end 78, a threaded cap 94 is screwed part way onto the threads at the top end 78. The connector is then purged with an inert gas, preferably the carrier gas. The breakseal 36 is then ruptured by screwing the cap 94 tightly onto the top end 78 of the "tee" connector 76, bringing the cap 94 into contact with the plunger 86, and forcing it through the breakseal 36.

The "tee" connector 76, like the valve 40, may be made of any suitable material possessing the necessary barrier properties, and may advantageously be made of the same polymer material as the bubbler. Similarly, the plunger 86 may be made of the same material as the valve, or, alternatively, it may be made of a different polymer, or of any other nonreactive material, such as quartz.

A second "tee" connector is attached to the inlet tube 20 in the same manner as discussed above in connection with the outlet tube 24.

In an alternative embodiment, the valves 40, or connectors 76, may be attached to the bubbler before shipping, either conventionally, or by molding or welding them onto the tubes, or into the top of the bubbler 10 in place of the tubes. In this embodiment, the breakseal 36 may either remain in the top of tubes 20 and 24, as disclosed above, it may be in the bubbler body itself (as when the valve is threaded directly into the bubbler), or it may be provided in the valve body of a conventional valve so that the valve is between the breakseal and the liquid source material. Moreover, to the extent consistent with safety and purity, and permissible under applicable shipping regulations in the country of shipment, the breakseal may be eliminated altogether. By attaching the valve prior to shipment, the valve may be coated with metal at the same time as the bubbler, thereby enhancing the barrier properties of the valve, and further minimizing the chance of contamination of the source material.

The invention is more fully illustrated in the following Example 1.

EXAMPLE 1

1500 cc Bubbler

Ultra high molecular weight polyethylene (UHMWPE) or linear high density polyethylene is rotationally molded into a generally cylindrical rigid-walled container having a 1500 cc capacity. The wall thickness is approximately ⅛ inch. Four round holes are then punched in the top of the container, in which an inlet tube, an outlet tube, a thermowell tube, and a fill tube are inserted and positioned. These tubes are then spin welded to attach them to the container body. The thermowell tube has a sealed bottom end. An annular LHDPE or UHMWPE float containing a magnet is slidably positioned on the thermowell tube inside the container. The inlet tube and the thermowell tube extend to within close proximity of the bottom of the container; the fill tube and the outlet tube terminate just inside the container.

Breakseals comprising 0.020 inch thick disks of LHDPE or UHMWPE are positioned in the top of the inlet tube and the outlet tube, and are ultrasonically welded into place. The container is then pressure tested at 25 psi.

Following pressure testing, the bubbler is fluorinated. The bubbler is preheated to 140 degrees F. for one-half hour, then placed in a vacuum chamber. following evacuation, $N_2$ and $F_2$ gas is introduced at atmospheric pressure for one hour. The bubbler then passes to the metallization process.

Metal sandwiched plastic tabs are attached to the top ends of the tubes with induction heating. A base coat is applied to the bubbler, which is then dried at 140 degrees F. for one-half hour. The dry bubbler is placed in the sputtering chamber, which is evacuated for 20 minutes to about 0.05 torr. Chromium is sputtered onto the exterior surface of the bubbler for two minutes to deposit a 0.6 to 1 mil metal coating. A clear, protective polyvinylidene chloride coating is applied to the exterior of the container over the metal, and the container is dried for 20 minutes at 140 degrees F.

The fabricated bubbler is next washed, dried, and filled with liquid trichloroethane, having a purity of 99.9999%. The fill tube is then heat sealed.

A nut is placed on both the inlet tube and the outlet tube, and a flat plug is placed over the end of each tube and is secured in place with the nut. The chemical-filled bubbler is double bagged in polyvinylidene chloride film and is placed inside a form-fitting styrofoam container. The container is then packed inside a cardboard container and shipped to the customer.

Although the present invention has been described in terms of certain preferred embodiments, it will be understood that some modifications may be made by those of ordinary skill in the art, without departing from the spirit of this invention. Accordingly, it is intended that the scope of the present invention be measured only by the appended claims, and reasonable equivalents thereof.

INDUSTRIAL APPLICATION

This invention finds application in the manufacture of semiconductor, electronic and optical devices.

We claim:

1. An article for containing liquid chemicals, comprising:

a moisture-impermeable bubbler having an organic polymer interior and a metal exterior;

said bubbler having a fill tube, a thermowell tube and an outlet tube communicating with the interior thereof;

a breakseal in said outlet tube, said breakseal adapted to be ruptured when said outlet tube is connected to a delivery conduit valve thereby preventing contamination of said liquid in said bubbler;

a valve fixed in sealing engagement to said outlet tube on said bubbler and having a metal exterior, and an organic polymer interior that is nonreactive with and noncontaminative of the liquid in said bubbler, said valve having the means to rupture said breakseal;

means disposed around said thermowell to enable a user to determine the level of liquid in said bubbler; and an ultra-high purity liquid chemical inside said bubbler selected from the group consisting of trichloroethane, phosphorus trichloride, trichloroethylene, tetramethoxysilane, phosphorus oxychloride, silicon tetrabromide, arsenic trichloride, phosphorus tribromide, and antimony pentachloride, said organic polymer material being nonreactive with and noncontaminative of said liquid chemical.

* * * * *